United States Patent [19]

Emerick

[11] 4,150,707

[45] Apr. 24, 1979

[54] METHOD AND APPARATUS FOR MAKING DENTAL CASTINGS

[76] Inventor: Harold C. Emerick, 5007 Wayne Trace, Fort Wayne, Ind. 46806

[21] Appl. No.: 867,115

[22] Filed: Jan. 5, 1978

Related U.S. Application Data

[63] Continuation-in-part of Ser. No. 785,495, Apr. 7, 1977, abandoned.

[51] Int. Cl.[2] ..... B22D 27/02; B22D 27/14; B22D 21/02

[52] U.S. Cl. ..... 164/52; 164/68; 164/284

[58] Field of Search ..... 164/52, 66, 67, 68, 164/252, 259, 306, DIG. 4, 284

[56] References Cited

U.S. PATENT DOCUMENTS

| | | | |
|---|---|---|---|
| 1,403,266 | 1/1922 | Rohmer | 164/306 |
| 2,125,080 | 7/1938 | Merrick | 164/67 |
| 2,171,778 | 9/1939 | Yantis | 164/68 |

*Primary Examiner*—Othell M. Simpson
*Assistant Examiner*—K. Y. Lin
*Attorney, Agent, or Firm*—Albert L. Jeffers; John F. Hoffman

[57] ABSTRACT

A method and apparatus for making dental castings wherein the crucible is supported on a platform having a central opening positioned beneath the crucible opening over the mold cavity of the investment, which, in turn, is supported on a platform having a central opening. The upper platform is lowered against the investment so that a single sealed vessel comprising the crucible and investment cavity is formed. Air is then admitted to the crucible and investment cavity at a point beneath the crucible opening so that both the investment and crucible may be purged, an arc is formed in the crucible thereby melting the casting material, and air under pressure is admitted to the top of a crucible thereby causing the molten casting material to flow into the investment cavity.

16 Claims, 4 Drawing Figures

METHOD AND APPARATUS FOR MAKING DENTAL CASTINGS

CROSS-REFERENCE TO RELATED APPLICATIONS

This is a continuation-in-part of Application Ser. No. 785,495 filed Apr. 7, 1977, and now abandoned.

BACKGROUND OF THE INVENTION

The present invention relates to the casting of metal alloys and other materials in the making of dental restorations such as crowns and bridges, and in particular to methods and apparatus for pressure casting.

In a commonly practiced method for making dental restorations, a wax pattern is obtained by applying the wax directly to the prepared tooth and then manually shaped by the dentist so that it has the proper contour and size. The shaped wax pattern is then removed from the tooth by means of a sprue pin, washed and dried. Since the final product which is to be permanently mounted on the tooth will have the same shape as the wax pattern, a mold, called an investment, must be made. A metal ring open at both ends is selected which must be large enough for the wax pattern to fit inside without touching the sides or extending to either end of the ring. An asbestos liner is often used to allow for thermal and hydroscopic expansion of the investment material and to serve as an insulator against the loss of heat during the casting process.

After the wax impression is placed within the casting ring, investment material, such as a mixture of plaster of Paris and some form of silica, is carefully packed around the pattern. A characteristic of investment materials is that they undergo expansion to compensate for the shrinkage of the casting as it cools. For example, the shrinkage of gold alloy is approximately 1.25% and if this were not compensated for, the resultant casting would be too small for a proper fit. The expansion of the investment material occurs in two phases, the first taking place as the material hardens and the second occurring when the investment is subjected to high temperature heat.

When the investment has set, the wax pattern is removed by placing the investment in a high temperature oven which causes the wax to melt and then volatize. As the investment is heated, it will undergo the aforementioned thermal expansion so that the mold cavity will be slightly larger than the wax pattern. After the invested ring is removed from the furnace, the casting is normally made within one minute or less before the investment cools and undergoes shrinkage. Although specific examples of prior art techniques for casting dental restorations will be discussed hereinafter, in general, casting comprises the forcing of a molten alloy such as a gold alloy into the chamber formed by the wax impression, permitting the casting to cool and then removing it from the investment.

The surface tension of the molten casting material is an important factor in making dental castings since it cannot effectively be overcome by gravity alone and the transfer of the metal to the mold is therefore not possible unless some additional force is exerted. In one method of pressure casting, compressed gas is applied to the molten metal by sealing the space above the metal which is supported on the ring encased investment and then admitting a compressed gas such as air, $CO_2$ or $N_2$ to this space.

In a second prior art technique, the gold alloy is placed on the investment above the cavity and a vacuum is applied to the bottom of the investment, which is porous in nature. The gold is heated by means of a torch and as it begins to melt, is drawn down into the mold cavity by the vacuum. Aside from the adverse effects which flame melting may have on the alloy, it is difficult to obtain a good vacuum on the investment so that often the material is not drawn down sufficiently to fill all the cavities of the mold.

A technique recently in use comprises placing the gold in a carbon crucible which is positioned beneath an inverted investment mold. The material is melted within the crucible and then the mold and crucible are simultaneously inverted 180° so that the molten material runs slowly into the mold. Compressed air is then admitted quickly to the casting chamber surrounding the crucible and mold to assist in filling the mold. The problem with this technique, however, is that the metal cools before it fills all the interstices of the mold cavity.

Another technique which is in common practice today is that of centrifugal casting wherein the mold is spun to develop the centrifugal forces necessary to force the molten metal into the mold. A severe disadvantage of centrifugal casting, however, is that the forces in the casting ring vary in different directions so that different areas of the mold cavity will be filled with greater difficulty than others. There is also some danger to this technique because the molten gold will occasionally be thrown from the mold as it spins thereby burning the technician. Such an incident also results in the loss of the gold which in itself is a very serious matter in view of the rapidly increasing cost of this metal.

Modern gold alloys used in making dental restorations often have a number of components such as platinum, palladium, silver, copper, tantalum, indium, and iridium to impart hardness, high chemical resistance and fine grain structure, but as gold is melted, it tends to purify itself by expelling the other metals alloyed with it. Because of this characteristic, it is important that the metal not be heated for a prolonged period of time but that the casting be made as soon as possible after the optimum degree of melting has been obtained. Another situation which must be avoided is that of oxidizing the gold either by using an oxidizing flame or by heating too long in an atmosphere in which oxidation can occur. This may be avoided to a certain extent when using a blow torch for heating by using only the reducing portion of the flame; and if the gold is contained within a crucible, a reducing atmosphere may be used.

Other things which are deleterious to the gold include breakdown of the carbon crucible which gives off a residue which may mix with the gold causing pits, and the presence of contaminant gases such as sulfur dioxide and sulfate gases and residues from the wax pattern which tend to collect within the mold cavity. Although the vacuum casting technique tends to remove some of these contaminant gases, the negative pressure is not able to satisfactorily purge the cavity.

One aspect of making dental castings, which was alluded to earlier, is the importance of balancing the expansion of the investment material as it is heated with the shrinking of the gold as it cools. If the casting is too large for the prepared tooth, a greater margin of cement must be relied on to achieve an acceptable fit. If the cement margin is imperfect, however, it will dissolve and the tooth will be lost from decay. If the inlay is too small, subsequent grinding and polishing or partial dissolution in an acid often results in an imperfect fit which again may cause discomfort to the patient and eventual tooth decay.

To assure that the investment expansion and casting shrinkage are properly balanced, it is necessary that the casting be made while the investment is at a very high temperature and preferably that little or no cooling is permitted to occur. The length of time which occurs between removing the investment from the furnace and admitting the molten casting material into the mold, as well as premature cooling of the casting material are two of the disadvantages of the prior art casting techniques and apparatus.

SUMMARY OF THE INVENTION

In order to overcome the aforementioned disadvantages of the prior art, the present invention comprises a method wherein the casting material is retained within the crucible during melting in an inert atmosphere and then forced downwardly through an opening in the bottom of the crucible into the purged investment cavity by the application of compressed air admitted to the crucible at a point above the melt.

It has been found that superior results are obtained by using air as the purging and pressurizing medium as opposed to an inert gas as taught by the prior art. As is known, an electric arc in an atmosphere of air consumes the oxygen component thereof. In the sealed and pressurized crucible, the oxygen is rapidly eliminated thereby leaving a mixture of nitrogen and carbon monoxide which prevents oxidation of the casting material both during melting and casting. It has been found that the higher pressure air does not cause oxidation of the casting material because the oxygen is consumed by the arc and/or because sufficient mixing is not able to occur prior to casting.

Specifically, the method of the present invention comprises providing a casting investment and a crucible containing a quantity of casting material positioned over the investment having an opening in register with the investment, admitting air to both the crucible and investment, heating the casting material by an electric arc sufficiently to cause the casting material to melt, and admitting air under pressure to the crucible above the molten casting material to force it to flow through the crucible opening into the investment.

The above method may be practiced by the apparatus of the present invention which comprises means for supporting a casting ring, a crucible having a bottom and an opening extending through the bottom, means for supporting the crucible above the casting ring support, means for admitting compressed air into the crucible through its opening, electric arc means for heating the contents of the crucible and means for admitting compressed air to the crucible above the crucible opening.

It is an object of the present invention to provide a method and apparatus for making dental castings wherein positive pressure is exerted on the molten casting material so that the mold cavity may be rapidly and completely charged thereby preventing premature cooling and incomplete casting.

It is a further object of the present invention to provide a method and apparatus for making dental castings wherein the investment cavity is purged of contaminant gases prior to casting.

It is also an object of the present invention to provide a method and apparatus for making dental castings wherein the mold may be rapidly positioned and charged with the casting material.

It is a further object of the present invention to provide a method and apparatus for making dental castings wherein the casting alloy is enveloped in air from which the oxygen component has been eliminated during melting and while it is being forced under pressure into the investment cavity thereby preventing oxidation and contamination of the casting.

Yet another object of the present invention is to provide a method and apparatus for making dental castings wherein equal pressure in the mold in all directions is assured.

A still further object of the present invention is to provide a method and apparatus for making dental castings wherein the degree of melting and temperature of the melt may be accurately measured and controlled.

Yet another object of the present invention is to provide a method and apparatus for making dental castings having sharp features and without internal porosity or oxidation.

A still further object of the present invention is to provide a method and apparatus for making dental castings wherein the expulsion of alloying elements from the gold alloy is prevented by minimizing the time during which it is in the molten state.

These and other objects will be apparent from the following description of the preferred embodiment.

DESCRIPTION OF THE PREFERRED EMBODIMENT

Figure 1:
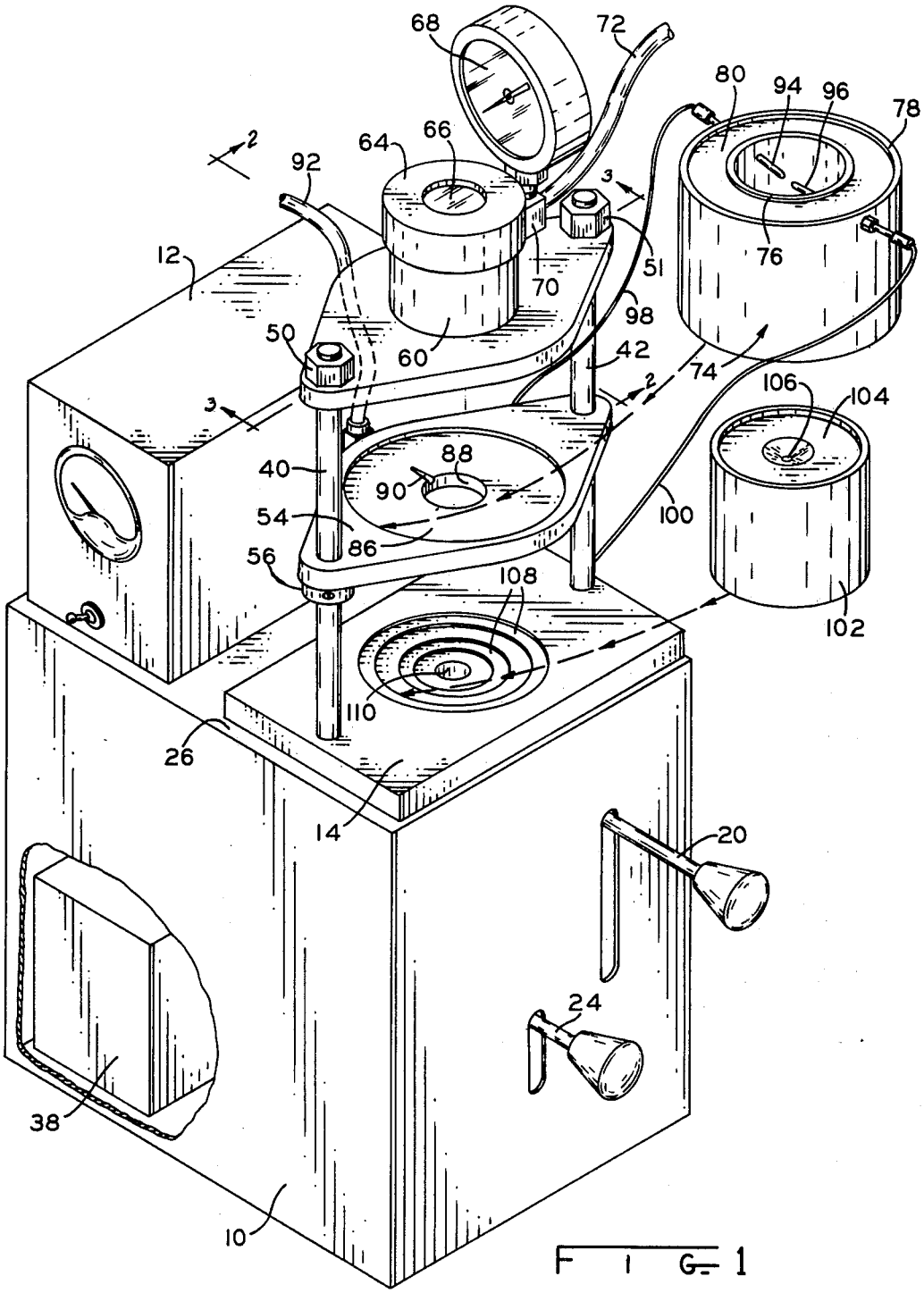
FIG. 1 is a perspective view of a preferred embodiment of the present invention with certain portions illustrated in exploded form to show the details of construction.

The apparatus of the present invention comprises a housing 10 on which is supported an electric arc control unit 12 and an investment ring support platform 14. Within housing 10 is a hydraulic jack 16 having a hydraulic cylinder 18, a pump lever 20 for raising plunger 22, and a release lever 24 for releasing the hydraulic pressure so that plunger 22 is able to descend. Pump arm 20 and release arm 24 extend through the front of housing 10 so as to facilitate their operation. Plunger 22 is maintained in contact with the top 26 of housing 10 directly below investment ring platform 14 by means of four springs 28 which connect with housing top 26 through brackets 30 and 32 and with the floating jack support platform 34 through eye bolts 36. Also contained within housing 10 is a transformer 38 which, together with control unit 12, functions to produce the current necessary for generating the electric arc used to melt the gold.

A pair of upstanding guide rods 40 and 42 which are rigidly connected to jack platform 34 at 44 and 46, extend through the top 26 of housing 10 and investment ring platform 14 and are rigidly attached to the crucible cover unit 48 by means of nuts 50 and 51 and lock rings 52. A crucible platform 54 which, like platform 14 and crucible cover 48 is preferably made of metal or other material capable of withstanding high temperatures, slips over guides 40 and 42 and is supported from underneath by lock rings 56 and 58. As handle 20 is pumped, the jack body will force platform 34 downwardly against the resistance of springs 28 thereby lowering crucible platform 54 and crucible cover 48.

Crucible cover 48 comprises a chamber 60 open on its bottom and aligned with an opening 62 in cover 48. A threaded cap 64 including a sight glass 66 is threaded on chamber 60 and a pressure guage 68 connects with chamber 60 through connector 70. An air inlet hose 72 is also connected to chamber 60 through connector 70.

A crucible 74 is shown supported on platform 54 and comprises an inner shell 76, made of a metal capable of withstanding high temperatures, received in an outer shell 78 also made of metal and separated therefrom by a ring of porcelain 80. The lower portion of inner shell 76 is conical in shape and has a plurality of small openings 82 for example, six openings, which connect with a larger opening 84. Crucible 74 is supported within a shallow recess 86 in platform 54 with its opening 84 aligned with an opening 88 in the platform 54. A fluid passageway 90 connects to air supply hose 92 and leads to opening 88.

A pair of carbon rich electrodes 94 and 96 extend into crucible 74 and are connected to electric arc control unit 12 by leads 98 and 100. In order to facilitate melting of the casting alloy (not shown), the electrodes 94 and 96 are angled downwardly towards the bottom of crucible 74.

An investment ring 102 containing an investment 104 with a mold cavity 106 therein is shown supported on platform 14 within one of the four concentric annular steps 108. Platform 14 is provided with a plurality of steps to accommodate varying sizes of investment rings 102 which are larger or smaller depending on the size of casting which is desired. Casting ring 102 is cylindrical in shape being open at its top and bottom ends which are aligned with opening 88 in platform 54 and opening 110 in platform 14, respectively. Opening 110 is open to the atmosphere through housing 10.

OPERATION

Figure 3:
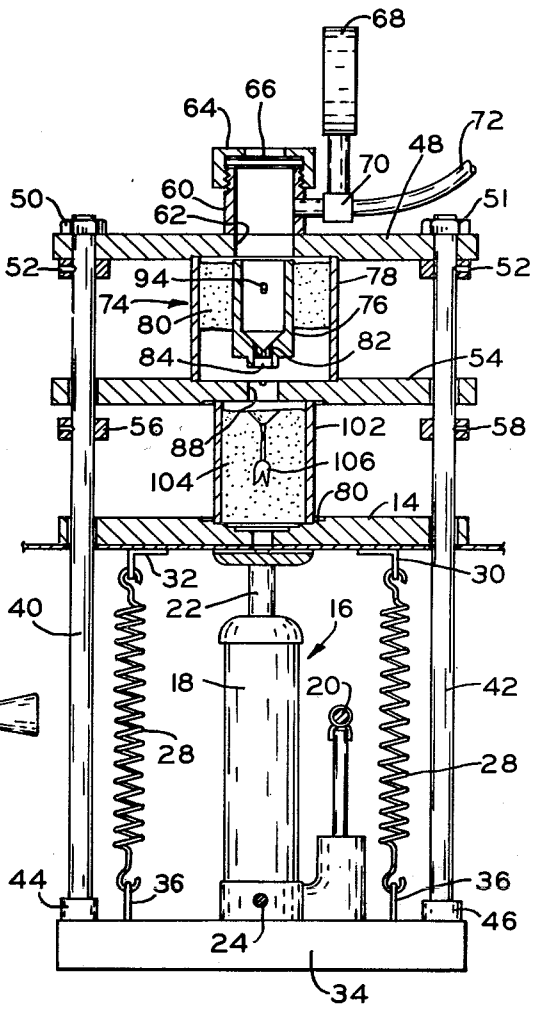
FIG. 3 is a sectional view taken along line 3—3 of FIG. 1 and viewed in the direction of the arrows.
Figure 4:
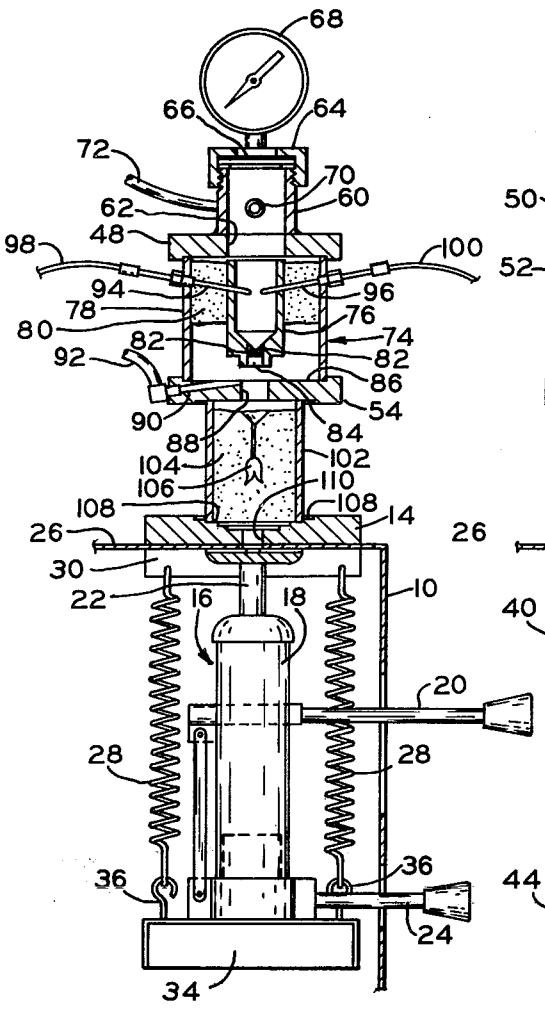
FIG. 4 is a sectional view similar to FIG. 2 but wherein the apparatus is locked into its operating position.
Figure 2:
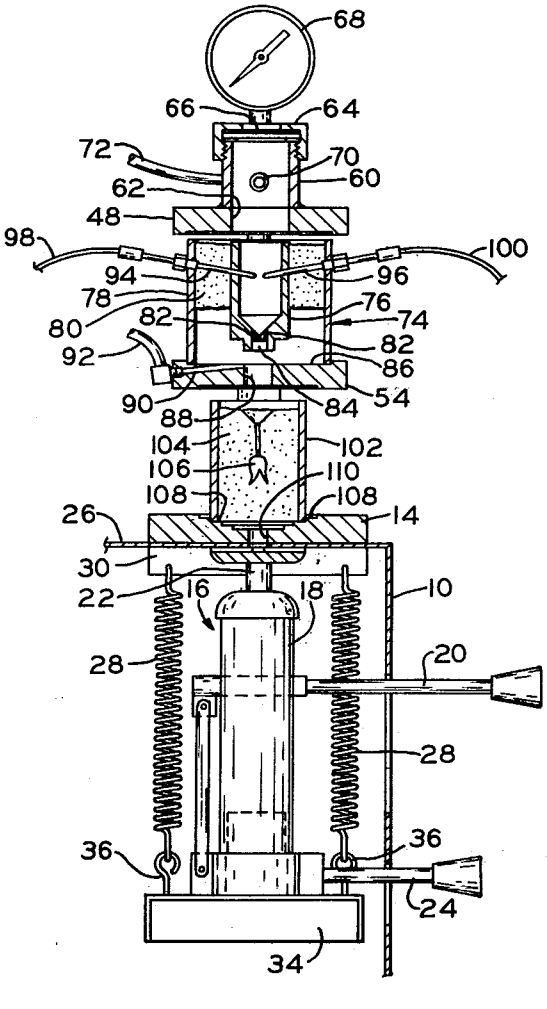
FIG. 2 is a sectional view taken along line 2—2 of FIG. 1 and viewed in the direction of the arrows.

The dental laboratory will normally receive the impression from the dentist. The wax pattern from the impression is encased in the investment so that it is merely necessary to place the investment and pattern in a very hot furnace to melt and volatize the wax and bring the investment up to the proper temperature to assure the correct degree of expansion. A quantity of gold or other alloy or material suitable for making dental castings is placed within the lower portion of crucible 74 above openings 82. The crucible 74 is then placed on platform 54 and the hot investment 104 in casting ring 102 is removed from the oven and immediately placed within the appropriate recess 108 in platform 14. Jack lever 20 is pumped thereby causing crucible platform 54 to seat against and seal casting ring 102 and crucible cover 48 to seat against and seal crucible 74. The apparatus in this position is illustrated in FIG. 3. When this has been done, the individual elements together form a single vessel comprising chamber 60, opening 62, crucible 74, opening 88, casting ring 102 and opening 110, which vessel is fluid tight with the exception of opening 110 which is open to the atmosphere through housing 10. Air is admitted to the multicompartmented vessel comprising the aforementioned elements through hose 92 and passageway 90. The air will flow up into crucible 74 around the quantity of gold (not shown) in the lower portion of crucible 74 and down into the mold cavity 106 thereby purging these areas of oxygen containing gases, sulfate gases and other contaminants. Since the investment 104 is porous in nature, the compressed air, which is preferably under a pressure of approximately 2 psi, will pass continuously through the mold cavity 106 and investment 104 into the atmosphere through opening 110 before and during heating of the gold. A suitable voltage is then applied to electrodes 94 and 96 thereby causing an arc to be struck. The crucible 74 is at ground potential relative to the voltage of the electrodes thereby causing the arc to be drawn down onto the gold so as to increase the rate at which it is melted. The oxygen component of the air will be rapidly consumed thereby leaving a mixture of nitrogen and carbon monoxide which prevents the gold from oxidizing during the melting process and furthermore any carbon which may be volatized by the high temperature will not deleteriously affect the gold.

The air pressure beneath the molten gold will prevent it from dripping or sagging through the crucible openings and solidifying prematurely.

After approximately 30 seconds the gold should be melted sufficiently and brought to the desired temperature to enable the casting to be made. The temperature of the molten gold may be determined by examining its color either optically through sight glass 66 or with the air of a pyrometer.

At this point, the air flowing through passageway 90 is shut off and air at a higher pressure (35 psi for example) is admitted to chamber 60 through hose 72. This increased pressure above the glob of molten gold is sufficient to overcome the surface tension which previously prevented it from flowing downwardly through openings 82. The molten gold is therefore forced downwardly through openings 82, 84 and 88 into mold cavity 106. Due to the porous nature of the investment 104, the air preceding the molten gold will escape to the atmosphere through opening 110. The higher pressure air may be maintained above the mold cavity 106 for the length of time necessary to assure complete filling of the mold and then turned off. Once the casting has solidified sufficiently, the apparatus is unlocked by operating lever 24 which releases the hydraulic pressure thereby allowing springs 28 to lift platform 54 and crucible cover 48. This permits the casting ring to be removed and the hardened casting to be recovered.

A very important aspect of the above described method and apparatus is the presence of the protective gas mixture of nitrogen and carbon monoxide around the gold while it is being heated and injected into the mold cavity. Because of the very high temperatures which must be employed to melt certain of the newer casting alloys, the carbon crucible tends to break down and produce small particles of carbon which are deleterious to the quality of the casting. With the presence of the protective gas and the absence of oxygen, however, the crucible does not break down. Furthermore, oxidation of the casting material is also effectively prevented. Because the molten gold is already in position for injection into the mold cavity, it need not be held in its molten state for any longer than a few seconds. This is advantageous because of the tendency for the gold to expel certain of the alloying elements at high temperature which may change the physical properties of the restoration. Furthermore, the mold cavity is continuously purged of any contaminant gases such as sulfur dioxide pattern residue and gaseous sulfates which are also deleterious to the casting.

Certain modifications to the apparatus and method which has been described will be obvious. If a number of successive castings are made, the crucible ring 78 and plates 48 and 54 may get hot so that the provision of a water jacket or one or more air spaces around crucible ring 78 becomes desirable. If desired, a copper and asbestos gasket may be used for sealing crucible 74.

As an alternative to compressed air, certain other compressed gases may be used. Furthermore, suitable alternative methods of heating, such as induction heating, may be utilized in certain cases.

While the principles of this invention have been described in connection with a specific apparatus, the description is made only by way of example and not as a limitation to the scope of the invention.

What is claimed is:

1. A method for making dental castings and the like comprising:

providing a porous casting investment mold having a pattern cavity therein, providing a crucible positioned above the investment mold and having at least one small bottom opening in register with the investment mold cavity, said crucible and investment mold cavity being in fluid tight communication with each other, providing a quantity of casting material in the crucible in a manner such that when the casting material is melted, it will flow into the crucible opening, introducing a compressed gas beneath the crucible opening and above the investment cavity so as to flow the gas up through the opening and purge the crucible and establish a fluid pressure beneath the crucible opening and to continuously flow the gas through the investment mold thereby purging the same, while continuing to introduce the compressed gas between the crucible opening and investment cavity, rapidly heating the casting material sufficiently to cause it to melt and flow to the crucible opening, the pressure beneath the crucible opening preventing substantial sagging or dripping of the molten material into or through the crucible opening and then admitting a compressed gas under pressure to the crucible above the molten casting material to force the casting material to flow through the crucible opening into the investment cavity, the pressure above the casting material being higher than the pressure below the crucible opening.

2. The method of claim 20 wherein the investment mold is contained within a receptacle having an opening at its top which is in substantially fluid tight connection with the crucible opening.

3. The method of claim 1 wherein the investment is contained within a receptacle having an opening at its top and the investment receptacle and the crucible are displaced vertically relative to each other such that their respective said openings are brought into fluid tight communication with each other prior to the step of admitting air into the crucible and investment.

4. The method of claim 1 wherein the casting material is heated by an electric arc of carbon rich electrodes.

5. The method of claim 1 wherein the compressed gas is air, the casting material and the air around it are heated by means of an electric arc of carbon rich electrodes in the crucible so as to substantially eliminate the free oxygen from the air in the crucible.

6. The method of claim 5 wherein the investment is contained within a receptacle which is in fluid communication with the crucible opening.

7. Apparatus for making dental castings and the like comprising:

means for supporting a casting ring, a crucible having a bottom and an opening extending through said bottom, means for supporting said crucible above said means for supporting a casting ring, means for admitting a purging gas under pressure into said crucible through said crucible opening so as to establish a fluid pressure beneath said crucible opening whereby molten casting material to be contained in said crucible will be prevented from substantial sagging and dripping into or through said crucible opening, means associated with said crucible for heating the casting material to be contained within the crucible, and means for admitting a gas under pressure to said crucible above said crucible opening whereby the casting material to be contained within the crucible will be forced through said crucible opening.

8. The apparatus of claim 7 wherein said means for supporting said crucible comprises a first platform having an opening extending therethrough beneath and in register with said crucible opening, and said first mentioned means for admitting air under pressure includes a fluid passage communicating with said platform opening.

9. The apparatus of claim 8 wherein said means for supporting a casting ring comprises a second platform having an opening extending therethrough in the central portion.

10. The apparatus of claim 9 including means connected to one of said first and second platforms for causing said first and second platforms to undergo vertical displacement relative to each other.

11. The apparatus of claim 10 wherein said means for causing displacement comprises means for lowering said first platform.

12. The apparatus of claim 11 wherein said means for lowering said platform comprises a fluid power cylinder connected to said first platform.

13. The apparatus of claim 9 wherein second platform includes a plurality of concentric annular steps on the upper surface thereof around said second platform opening.

14. The apparatus of claim 9 including:

a mold supported on said second platform, said mold comprising an investment mold encased in a casting ring having a top opening in register with said first platform opening and a bottom opening communicating with said second platform opening, and means connected to said platforms for causing said platforms to undergo vertical displacement whereby said first platform seals against said casting ring, and whereby said crucible, said crucible opening, said first platform opening and said casting ring form a single vessel which is substantially fluid tight except for said second platform opening.

15. The apparatus of claim 7 wherein said means for heating comprises carbon rich electric arc electrodes in said crucible, said crucible being at ground potential with respect to said electrodes.

16. The apparatus of claim 7 including a plurality of small openings in said crucible bottom through which said air under pressure is admitted to said crucible.

* * * * *

UNITED STATES PATENT AND TRADEMARK OFFICE

CERTIFICATE OF CORRECTION

PATENT NO. : 4,150,707

DATED : April 24, 1979

INVENTOR(S) : Harold C. Emerick

It is certified that error appears in the above-identified patent and that said Letters Patent are hereby corrected as shown below:

Col. 5, line 12, change "guage" to -- gauge --.

Claim 2, Col., 7, line 52, change "20" to -- 1 --.

Claim 3, Col. 7, line 55, "mold" should be inserted after "investment".

Signed and Sealed this

*Eleventh* Day of *September 1979*

[SEAL]

*Attest:*

*Attesting Officer*

LUTRELLE F. PARKER

*Acting Commissioner of Patents and Trademarks*